US007703370B2

(12) United States Patent
Melin et al.

(10) Patent No.: US 7,703,370 B2
(45) Date of Patent: Apr. 27, 2010

(54) APPARATUS AND METHOD FOR INHIBITING INADVERTENT INITIATION OF A MUNITION

(75) Inventors: Roger W. Melin, Arlington, TX (US); John S. Buchan, Fort Worth, TX (US); Joseph M. Wright, Southlake, TX (US); Chris E. Williams, Mansfield, TX (US); Daren C. Davis, Granbury, TX (US)

(73) Assignee: Lockheed Martin Corporation, Grand Prairie, TX (US)

( * ) Notice: Subject to any disclaimer, the term of this patent is extended or adjusted under 35 U.S.C. 154(b) by 1239 days.

(21) Appl. No.: 11/123,292

(22) Filed: May 6, 2005

(65) Prior Publication Data

US 2010/0064926 A1 Mar. 18, 2010

Related U.S. Application Data

(60) Provisional application No. 60/569,429, filed on May 7, 2004.

(51) Int. Cl.
*F42B 33/00* (2006.01)

(52) U.S. Cl. ..... 86/50

(58) Field of Classification Search ..... 86/50; 89/36.02, 1.8–1.82; 102/4
See application file for complete search history.

(56) References Cited

U.S. PATENT DOCUMENTS

| | | | | |
|---|---|---|---|---|
| 2,404,441 | A * | 7/1946 | Hopkins | 89/1.1 |
| 3,024,703 | A * | 3/1962 | Herold | 89/1.811 |
| 3,093,033 | A * | 6/1963 | Draim et al. | 89/1.809 |
| 3,122,891 | A * | 3/1964 | Thomas | 62/52.1 |
| 3,166,977 | A * | 1/1965 | Pickett et al. | 89/1.809 |
| 3,180,225 | A * | 4/1965 | Draim | 89/1.809 |
| 4,079,675 | A * | 3/1978 | Beumel, Jr. | 102/401 |
| 4,916,999 | A * | 4/1990 | Palmer et al. | 89/1.815 |
| 5,151,557 | A * | 9/1992 | Bracuti et al. | 102/435 |
| 5,864,767 | A * | 1/1999 | Drumgoole et al. | 588/313 |
| RE36,912 | E * | 10/2000 | Donovan | 110/237 |
| 6,173,662 | B1 * | 1/2001 | Donovan | 110/237 |
| 7,226,878 | B2 * | 6/2007 | Wagner et al. | 442/59 |
| 2005/0266748 | A1 * | 12/2005 | Wagner et al. | 442/59 |
| 2006/0234577 | A1 * | 10/2006 | Wagner et al. | 442/135 |

FOREIGN PATENT DOCUMENTS

| | | | |
|---|---|---|---|
| WO | WO 9400087 | A1 * | 1/1994 |

* cited by examiner

*Primary Examiner*—Troy Chambers
(74) *Attorney, Agent, or Firm*—Davis Patent Services, LLC

(57) ABSTRACT

A device for inhibiting inadvertent initiation of a munition includes a sorbing refrigeration device adapted to at least partially surround an energetic material of the munition. A container includes an energetic material and a sorbing refrigeration device at least partially surrounding the energetic material. A method for inhibiting an inadvertent initiation of a munition includes cooling an energetic material of the munition by sorption refrigeration.

30 Claims, 4 Drawing Sheets

APPARATUS AND METHOD FOR INHIBITING INADVERTENT INITIATION OF A MUNITION

CROSS-REFERENCE TO RELATED APPLICATIONS

This application claims the benefit of U.S. Provisional Application No. 60/569,429, filed 7 May 2004, entitled "Apparatus and Method of Inhibiting Inadvertent Initiation of a Munition."

BACKGROUND

1. Field of the Invention

This invention relates to a method and apparatus for inhibiting inadvertent initiation of a munition.

2. Description of Related Art

Energetic materials, such as explosives and propellants, are often found in confined spaces within munitions. Under normal conditions, these materials are unlikely to detonate or burn spontaneously; however, many are sensitive to heat and mechanical shock. For example, when exposed to extreme heat (as from a fire) or when impacted by bullets or fragments from other munitions, the energetic materials may be initiated, causing the munitions in which they are disposed to inadvertently react at a rate ranging from slow burning to detonation.

Efforts have been made to develop insensitive munitions, which are munitions that are generally incapable of detonation except in its intended mission to destroy a target. In other words, if fragments from an explosion strike an insensitive munition, if a bullet impacts the munition, or if the munition is in close proximity to a target that is hit, it is unlikely that the munition will detonate. Similarly, if the munition is exposed to extreme temperatures, as from a fire, the munition will likely only burn, rather than detonate.

One way that munitions have been made more insensitive is by developing new explosives and propellants that are less likely to be initiated by heating and/or inadvertent impact. Such materials, however, are typically less energetic and, thus, may be less capable of performing their intended task. For example, a less energetic explosive may be less capable of destroying a desired target than a more energetic explosive. A less energetic propellant may be capable of producing less thrust than a more energetic propellant, thus reducing the speed and/or the range of the munition. Additionally, the cost to verify and/or qualify new explosives and/or propellants, from inception through arena and system-level testing, can be substantial when compared to improving the insensitive munition compliance of existing explosives and/or propellants.

Other development efforts have resulted in devices that are designed to vent pressure within the munition in the event the munition is exposed to a fire. Some such devices, known as the thermally initiated venting systems, include an external thermal cord which, when ignited, triggers an out-of-line device that, in turn, detonates a linear shaped charge. The detonation of the linear shaped charge weakens the housing containing the munition's energetic material, allowing the energetic material to vent without exploding. However, such thermally initiated venting systems do not address other insensitive munitions issues, such as bullet impact, fragment impact, and slow heating (i.e., "cook-off") of the energetic material.

The present invention is directed to overcoming, or at least reducing, the effects of one or more of the problems set forth above.

SUMMARY OF THE INVENTION

In one aspect of the present invention, a device for inhibiting inadvertent initiation of a munition is provided. The device includes a sorbing refrigeration device adapted to at least partially surround an energetic material of the munition.

In another aspect of the present invention, a container is provided. The container includes an energetic material and a sorbing refrigeration device at least partially surrounding the energetic material.

In yet another aspect of the present invention, a method for inhibiting an inadvertent initiation of a munition is provided. The method includes cooling an energetic material of the munition by sorption refrigeration.

Additional objectives, features and advantages will be apparent in the written description which follows.

DESCRIPTION OF THE DRAWINGS

The novel features believed characteristic of the invention are set forth in the appended claims. However, the invention itself, as well as, a preferred mode of use, and further objectives and advantages thereof, will best be understood by reference to the following detailed description when read in conjunction with the accompanying drawings, in which the leftmost significant digit(s) in the reference numerals denote (s) the first figure in which the respective reference numerals appear, wherein:

Figure 1:
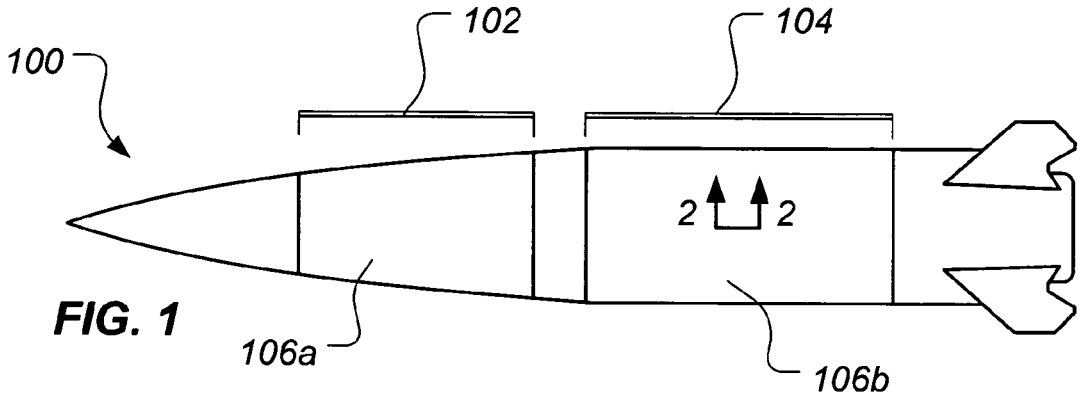
FIG. 1 is a stylized, plan, side view of a munition according to the present invention.

While the invention is susceptible to various modifications and alternative forms, specific embodiments thereof have been shown by way of example in the drawings and are herein described in detail. It should be understood, however, that the description herein of specific embodiments is not intended to limit the invention to the particular forms disclosed, but on the contrary, the intention is to cover all modifications, equivalents, and alternatives falling within the spirit and scope of the invention as defined by the appended claims.

DETAILED DESCRIPTION OF THE PREFERRED EMBODIMENT

Illustrative embodiments of the invention are described below. In the interest of clarity, not all features of an actual implementation are described in this specification. It will of course be appreciated that in the development of any such actual embodiment, numerous implementation-specific decisions must be made to achieve the developer's specific goals, such as compliance with system-related and business-related constraints, which will vary from one implementation to another. Moreover, it will be appreciated that such a development effort might be complex and time-consuming but would nevertheless be a routine undertaking for those of ordinary skill in the art having the benefit of this disclosure.

The present invention relates to an apparatus and method for inhibiting inadvertent initiation of a munition, or a group of munitions. Some examples of munitions are missiles, rockets, bombs, and ballistic rounds, although this list is neither exhaustive nor exclusive. Rather, the scope of the present invention encompasses inhibiting inadvertent initiation of any container housing an energetic material. As discussed above, munitions typically include an energetic material in the form of a propellant for propelling the munition and/or an explosive for inflicting damage to a desired target. The present invention seeks to inhibit inadvertent initiation of a munition by employing a sorption refrigeration device to selectively reduce the temperature of the munition. In some embodiments, the sorption refrigeration device also acts as an armor to inhibit a hostile round or fragment from penetrating the refrigeration device into the energetic material.

Sorption refrigeration operates through the sorption of a refrigerant (i.e., a sorbate) by a sorbent. Sorption is the taking up and holding of a substance by either adsorption or absorption. A sorbent is a material that has a tendency to take up and hold another substance by either adsorption or absorption. Adsorption is the adhesion in an extremely thin layer of molecules (as of gases, solutes, or liquids) to the surfaces of solid bodies or liquids with which they are in contact. Absorption is to take something in through or as through pores or interstices.

FIG. 1 provides a stylized view of one embodiment of a munition, i.e., a missile 100, according to the present invention. The missile 100 includes, among other elements, a payload section 102 and a propulsion section 104. In the illustrated embodiment, the payload section 102 contains explosive material (not shown) used to inflict damage on a target, while the propulsion section 104 contains propellant (also not shown) for use in propelling the missile 100 to the target. The explosive material and the propellant may be any known to the art suitable for the intended purpose of munition 100. The payload section 102 and the propulsion section 104 further include sorption refrigeration devices 106*a*, 106*b*, respectively, that are capable of inhibiting the inadvertent initiation of the energetic materials (i.e., the explosive and propellant materials) therein, as will be discussed below.

While the sorption refrigeration devices 106 are shown in FIG. 1 to be only surrounding the payload section 102 and the propulsion section 104, respectively, the present invention is not so limited. Rather, the sorption refrigeration devices 106 are adapted to at least partially surround an energetic material of the munition 100. In various embodiments, the sorption refrigeration devices 106 may be joined into one case surrounding both the payload section 102 and the propulsion section 104 or may surround other portions of the missile 100 in addition to the payload section 102 and the propulsion section 104. The sorption refrigeration devices 106 are illustrated in FIG. 1 as extending to an external surface of the missile 100; however, one or more sorption refrigeration devices 106 (or like refrigeration devices) may alternatively be disposed within the missile 100 such that it at least partially surrounds at least one of the energetic materials disposed therein. The sorption refrigeration devices 106 may comprise a portion of the case of the munition 100 or may be disposed within the munition 100 but at least partially surrounding at least one of the energetic materials disposed therein.

According to the present invention, one or more sorption refrigeration devices 106 may alternatively comprise a portion of a storage container or launch container, rather than comprising a portion of the munition 100 itself, as will be discussed more fully later. In such embodiments, the sorption refrigeration device or devices 106 at least partially surround one or more of the munitions contained therein.

Figure 2:
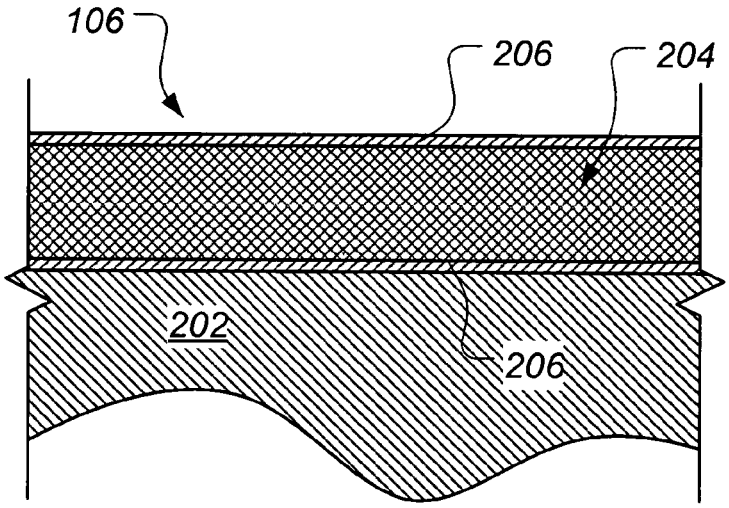
FIG. 2 is a stylized, cross-sectional view of a portion of the munition of FIG. 1, taken along the line 2-2 of FIG. 1, illustrating a first embodiment of a sorption refrigeration device according to the present invention.

FIG. 2 illustrates a cross-sectional view (taken along the line 2-2 of FIG. 1) of a first embodiment of the sorption refrigeration device 106 according to the present invention, which at least partially surrounds an energetic material 202. The sorption refrigeration device 106 comprises sorbent portion 204 capable of retaining a refrigerant and then releasing the refrigerant to cool the energetic material 202. Certain sorption refrigeration processes are described in U.S. Pat. Nos. RE34,259; 5,298,231; 5,328,671; 5,441,716; 5,025,635; 5,079,928; 5,161,389; 5,186,020; 6,224,842; 6,477,856; 6,415,625; 6,282,919; 6,276,166; 6,130,411; 5,901,780; 5,666,819; 5,664,427; 5,628,205; 5,598,721; 5,477,706; 5,384,101; 5,360,057; 5,335,510; 5,295,358; 5,291,753; 5,289,690; 5,263,330; 5,241,831; 5,165,247; and 4,848,994, which are all hereby incorporated by reference in their entireties for all purposes. For example, the sorbent portion 204 may comprise COMBAM™ material from Rocky Research of Boulder City, Nev. The present invention, however, is not limited to these sorption refrigeration processes and materials. In various embodiments, the sorbent portion 204 may comprise, among other substances, one or more metal salts, one or more complex compounds produced from one or more metal salts, one or more metal hydrides, zeolite, activated carbon, alumina, and/or silica gel. The refrigerant may comprise, among other substances, water, amines, alcohols, or ammonia.

Figure 3:
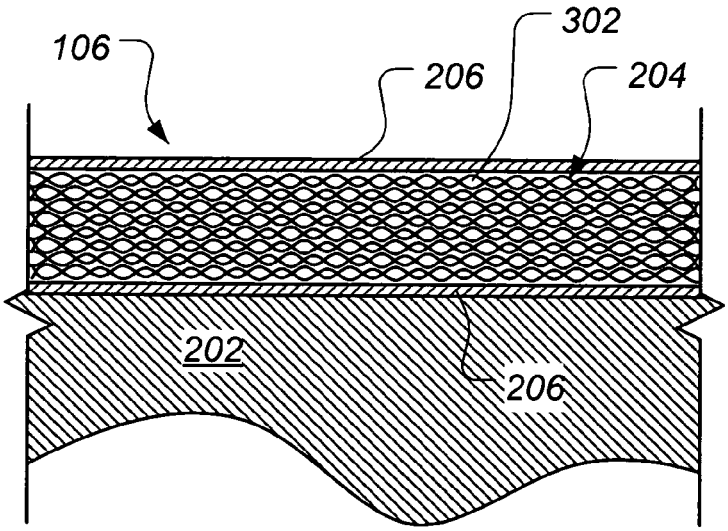
FIG. 3 is a stylized, cross-sectional view corresponding to that of FIG. 2 in which a sorbent portion comprises a plurality of layers.
Figure 4:
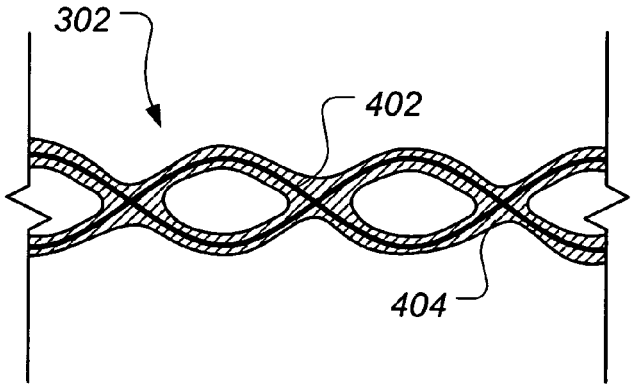
FIG. 4 is a stylized, cross-sectional view of one of the layers of FIG. 3.

FIG. 3-FIG. 4 illustrates a particular embodiment of the present invention wherein the sorbent portion 204 comprises a plurality of layers 302 (only one labeled for clarity). FIG. 3 provides a view of the sorption refrigeration device 106 corresponding to that of FIG. 2. FIG. 4 provides an enlarged view of one of the plurality of layers 302. As shown in FIG. 4, the layer 302 comprises a substrate 402 supporting a sorbent 404. The sorbent 404 may be any of the substances discussed earlier as comprising the sorbent portion 204.

The substrate 402 may be a woven material (as illustrated in FIG. 3), such as fabric or cloth, or it may be an unwoven material, such as yarn, felt, rope, mat, or similar material in which the strands or fibers have been tangled or otherwise mixed, twisted, pressed, or packed to form a coherent substrate 402. Alternatively, the entire sorbent portion 204 may comprise a single woven or unwoven layer, or it may comprise both woven and unwoven layers 302. In various embodiments, the substrate 402 may comprise any of the materials disclosed in U.S. Pat. Nos. RE34,259; 5,298,231; 5,328,671; 5,441,716; 5,025,635; 5,079,928; 5,161,389; 5,186,020; 6,224,842; 6,477,856; 6,415,625; 6,282,919; 6,276,166;

6,130,411; 5,901,780; 5,666,819; 5,664,427; 5,628,205; 5,598,721; 5,477,706; 5,384,101; 5,360,057; 5,335,510; 5,295,358; 5,291,753; 5,289,690; 5,263,330; 5,241,831; 5,165,247; and 4,848,994, incorporated by reference above.

The substrate 402 may, in some embodiments, additionally inhibit the inadvertent activation of energetic materials in the missile 100 (or in other such munitions) by decreasing the likelihood of a projectile (e.g., a ballistic round, shrapnel, etc.) entering the energetic material 202. In such embodiments, the substrate 402 acts as an armor layer to impede the progress of such projectiles. In such embodiments, the substrate 402 may comprise one or more of silicon carbide, alumina, glass, an aramid fiber (e.g., Kevlar®, Vectran®, Nomex®, Spectra®, Teflon®, Conex®, etc.), an olefin-aramid fiber combination (e.g., a polyethylene-Spectra® combination), high-density polyethylene, melamine, polybenzimidazole, polyphenylenebenzobisozazole, phenolic (e.g., novaloid phenolic), polyacrylate, polyacrylate liquid crystal, polyphenylene sulfide, polytetrafluoroethylene, polyimide, and polyamideimide. Further, the substrate 402 may comprise either nylon-based, pitch-based, or polyacrylonitrile-based carbon or graphite.

To prepare the sorption refrigeration device 106 for use, the sorbent portion 204 is allowed to sorb the refrigerant, usually in vapor form. The sorbent portion 204 and its sorbate (i.e., the refrigerant) are then sealed within an encapsulating member 206. In one embodiment, the encapsulating member 206 comprises an epoxy, although alternative thermosetting or thermoplastic resins (e.g., a polyamide, an aliphatic amine, a ketamine, or an ester) could be employed as an encapsulant. The sorption refrigeration device 106 is then assembled into the munition (e.g., the munition 100).

Figure 5:
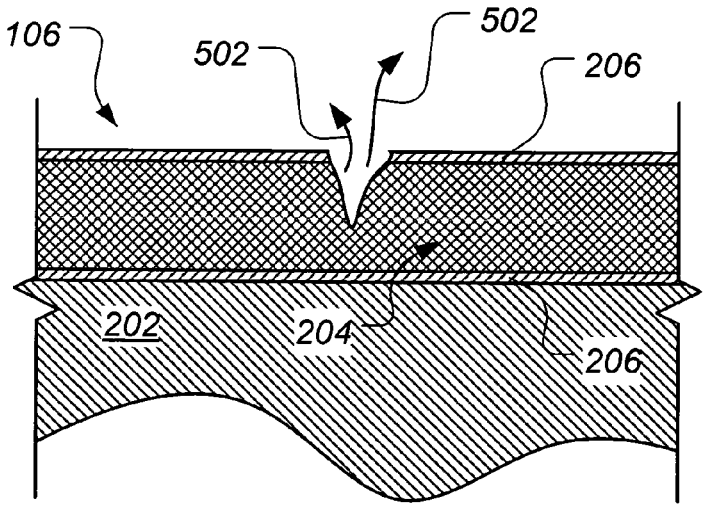
FIG. 5 is a stylized, cross-sectional view corresponding to that of FIG. 2 illustrating an operation of the sorption refrigeration device after being breached.

FIG. 5 illustrates an example of the sorption refrigeration device 106 in use. In the illustrated example, a projectile has impacted the sorption refrigeration device 106 and has breached the encapsulating member 206. As the device 106 is no longer sealed, the sorbent portion 204 is exposed to the atmosphere, creating a pressure differential between the sorbent portion 204 and the atmosphere. The refrigerant evolves from the sorbent portion 204 (as indicated by arrows 502), which is an endothermic process. Heat from the energetic material 202 is carried into the atmosphere via the refrigerant. The energetic material 202 is cooled, thus decreasing the likelihood of inadvertent initiation. Refrigerant vapors evolving from the sorbent portion 204 may also aid in extinguishing the energetic material 202 should the energetic material 202 burn.

Figure 6:
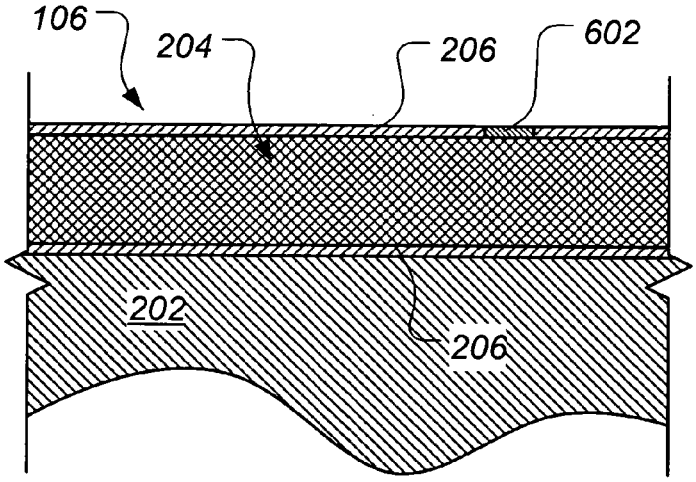
FIG. 6 is a stylized, cross-sectional view corresponding to that of FIG. 2 in which a temperature-sensitive plug has been included.

As illustrated in FIG. 6, which is an alternative implementation to that of FIG. 2, the sorbent refrigeration device 106 may also include a temperature-sensitive plug 602 incorporated into the encapsulating member 206. The material comprising the plug 602, or the design of the plug itself, may be selected based upon the temperature at which the sorbent refrigeration device 106 is desired to operate. For example, the plug 602 may comprise a plastic or wax that would melt when a certain temperature is reached. Alternatively, the plug 602 may comprise a mechanism that opens when a certain temperature is reached. Further, the size of the opening selectively obstructed by the plug 602 may be sized to control the release rate of the refrigerant from the sorbent portion 204.

Figure 7:
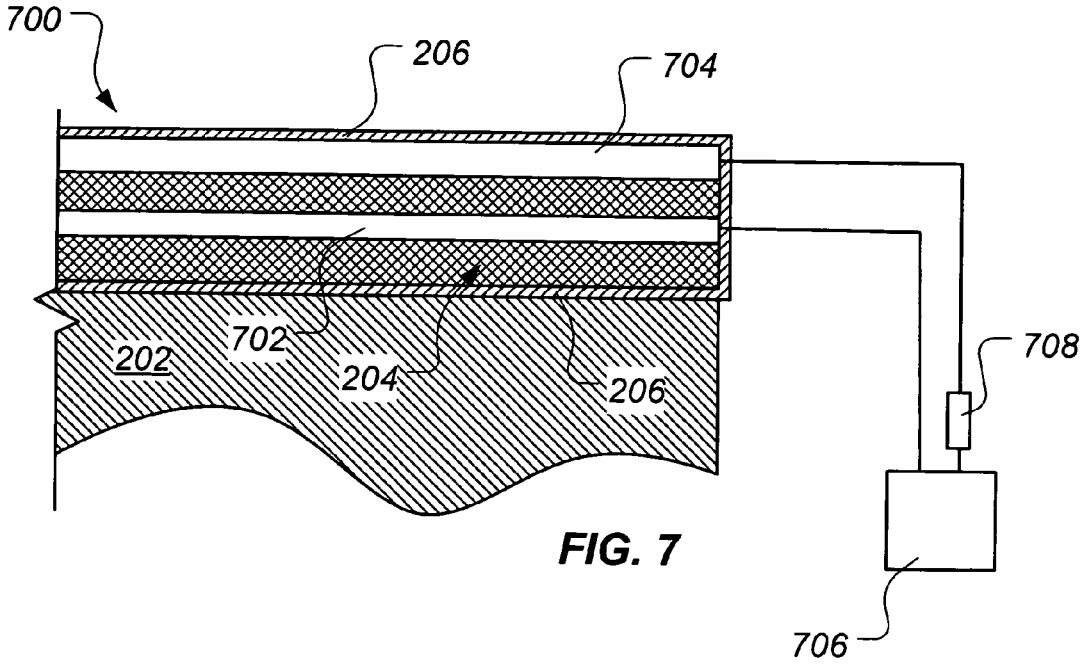
FIG. 7 is a stylized, cross-sectional view, taken along the line 2-2 of FIG. 1, and schematic view of a portion of the munition of FIG. 1 illustrating a second embodiment of a sorption refrigeration device according to the present invention.

FIG. 7 illustrates a second embodiment of a sorbent refrigeration device 700 according to the present invention. In this embodiment, the sorption refrigeration device 106 has been modified to include a return conduit 702 and an evaporator 704, both embedded in (or at least in contact with) the sorbent portion 204. The conduit 702 and the evaporator 704 are configured (e.g., perforated) such that the refrigerant may pass into the conduit 702 and out the evaporator 704. The conduit 702 is in fluid communication with a receiver 706 such that, when the refrigerant is desorbed from the sorbent portion 204, it can flow to a receiver 706. The evaporator 704 is also in fluid communication with the receiver 706, via a capillary tube 708, which meters the flow of the refrigerant, as is known to the art.

The sorption refrigeration device 700 can be operated substantially continuously, if desired. In an initial state, the sorbent portion 204 is fully sorbed with refrigerant. Upon heating (e.g., from an adjacent fire, slow cook-off, etc.), the refrigerant is desorbed from the sorbent portion 204 and flows to the receiver 706 through the conduit 702, carrying heat with it. The refrigerant, which has cooled in the receiver 706, then flows through the capillary tube 708 and into the evaporator 704. The cooled refrigerant correspondingly cools the energetic material 202 and the sorbent portion 204, thus allowing the sorbent portion 204 to sorb the refrigerant. The process may then be repeated as desired.

If, however, the encapsulating member 206 is breached (e.g., by a ballistic strike), the device 700 of FIG. 7 will no longer be a closed-loop system. Thus, the device 700 may operate in the same way as the sorption refrigeration device 106.

Figure 8:
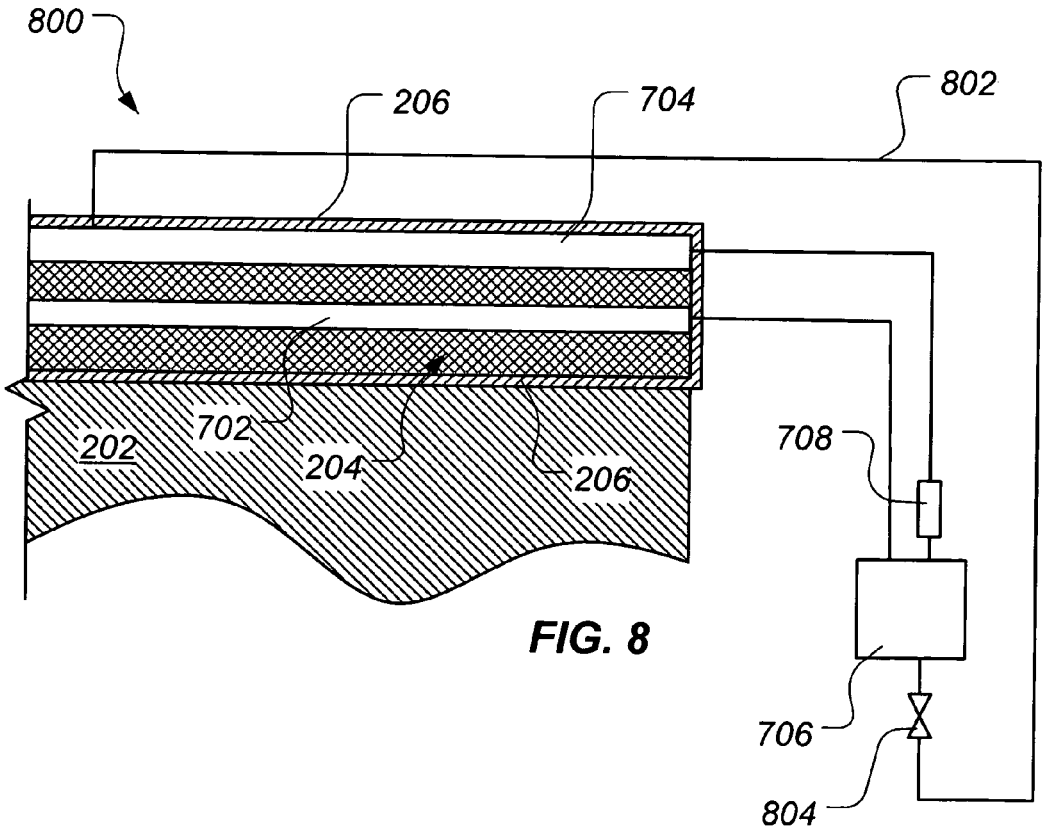
FIG. 8 is a stylized, cross-sectional and schematic view corresponding to that of FIG. 7 illustrating a third embodiment of a sorption refrigeration device according to the present invention.

FIG. 8 illustrates a third embodiment of a sorption refrigeration device 800 according to the present invention. The device 800 corresponds to the sorption refrigeration device 700, except that the evaporator 704 is in fluid communication with the receiver 706 via a secondary conduit 802. If desired, excess refrigerant not sorbed by the sorbent portion 204 may be selectively returned to the receiver 706 by opening a valve 804, either manually or by automated means, e.g. by a control system (not shown).

While the embodiments of FIG. 7 and FIG. 8 are illustrated as comprising sorbing portions 204 that include a single layer, the present invention is not so limited. Rather, the sorbent portions 204 of these embodiments may include a plurality of layers, such as the layers 302 of FIG. 3.

Figure 9:
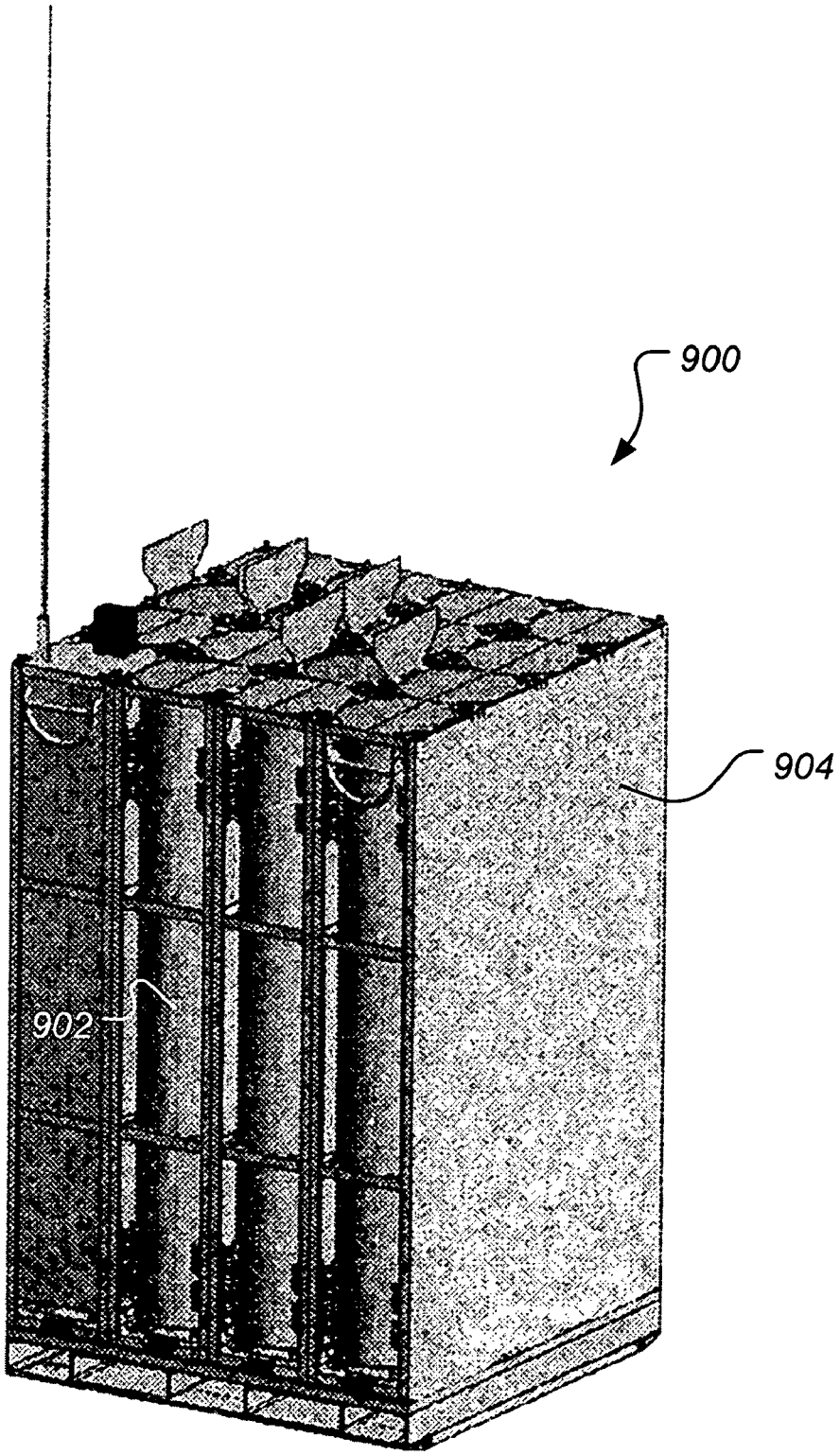
FIG. 9 is a perspective view of one embodiment of a munition container comprising a sorption refrigeration device, all according to the present invention.

FIG. 9 illustrates an implementation according to the present invention of a sorption refrigeration device in a munition container 900. The container 900 may, in various embodiments, be a storage container or a launch container and may take on forms that differ from that illustrated in FIG. 9. In the illustrated embodiment, the container 900 comprises a plurality of storage or launch tubes 902 (depending upon the type of container). Munitions (not shown) are stored within the tubes 902. The container 900 comprises a plurality of sorption refrigeration devices 904 (only one labeled for clarity) at least partially surrounding the munitions. In various embodiments, the sorption refrigeration devices 904 correspond to the sorption refrigeration devices 106, 700, 800. It should be noted that, in FIG. 9, one sorption refrigeration device 904 has been removed from the container 900 for clarity to reveal the tubes 902. In one embodiment, sorption refrigeration devices 904 comprise at least four sides of the container 900 to surround the munitions therein. However, even as illustrated in FIG. 9, the sorption refrigeration devices 904 at least partially surround the munitions contained within the tubes 902 and, thus, is adapted to at least partially surround energetic materials of the munitions.

Alternatively, according to the present invention, one or more of the sorption refrigeration devices 106, 700, 800, 904 may be incorporated into the tubes 902, such that, upon activation, they cool the energetic materials of the munitions disposed therein.

In various embodiments, the sorption refrigeration process carried out by the sorption refrigeration devices 106, 700,

800, 904 corresponds to such processes disclosed in U.S. Pat. Nos. RE34,259; 5,298,231; 5,328,671; 5,441,716; 5,025,635; 5,079,928; 5,161,389; 5,186,020; 6,224,842; 6,477,856; 6,415,625; 6,282,919; 6,276,166; 6,130,411; 5,901,780; 5,666,819; 5,664,427; 5,628,205; 5,598,721; 5,477,706; 5,384,101; 5,360,057; 5,335,510; 5,295,358; 5,291,753; 5,289,690; 5,263,330; 5,241,831; 5,165,247; and 4,848,994, incorporated by reference above. Further, particular implementations of the present invention may incorporate more than one sorption refrigeration device 106, 700, 800, 904. Further, particular embodiments of the present invention may comprise more than one conduit 702, evaporator 704, receiver 706, capillary tube 708, and/or secondary conduit 802.

The sorption refrigeration devices 106, 700, 800, 904 may also be disposed proximate one or more electronic or other components in the munition 100 or container 900 to cool the components in the same way as described above. For example, heat generated by a component, such as an electronic component, would activate the sorption refrigeration device 106, 700, 800, 904, and the heat would at least partially be removed by those devices, in the same way as heat from an adjacent fire, slow cook-off, etc. would be removed in the examples discussed above.

The particular embodiments disclosed above are illustrative only, as the invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular embodiments disclosed above may be altered or modified and all such variations are considered within the scope and spirit of the invention. Accordingly, the protection sought herein is as set forth in the claims below. It is apparent that an invention with significant advantages has been described and illustrated. Although the present invention is shown in a limited number of forms, it is not limited to just these forms, but is amenable to various changes and modifications without departing from the spirit thereof.

What is claimed is:

1. A device for inhibiting inadvertent initiation of a munition, comprising:

a sorbing refrigeration device adapted to at least partially surround an energetic material of the munition.

2. A device, according to claim 1, wherein the sorbing refrigeration device comprises:

a sorbent portion capable of sorbing a refrigerant and an encapsulating member sealing the sorbent portion.

3. A device, according to claim 2, wherein the encapsulating member comprises:

an epoxy.

4. A device, according to claim 2, wherein the sorbent portion comprises:

at least one of one or more metal salts, one or more complex compounds produced from one or more metal salts, one or more metal hydrides, zeolite, activated carbon, alumina, and silica gel.

5. A device, according to claim 2, wherein the refrigerant is one of water, amines, alcohols, and ammonia.

6. A device, according to claim 2, further comprising:

a temperature-sensitive plug disposed through the encapsulating member.

7. A device, according to claim 2, wherein the sorbent portion comprises:

a woven material.

8. A device, according to claim 2, wherein the sorbent portion comprises:

an unwoven material.

9. A device, according to claim 2, further comprising:

a return conduit in fluid communication with the sorbent portion;

an evaporator in fluid communication with the sorbent portion;

a capillary tube; and a receiver in fluid communication with the return conduit and in fluid communication with the evaporator via the capillary tube.

10. A device, according to claim 2, further comprising:

a secondary conduit, the receiver being in fluid communication with the evaporator via the secondary conduit.

11. A device, according to claim 1, wherein the sorbing refrigeration device comprises:

a refrigerant, a sorbent portion capable of sorbing the refrigerant, and an encapsulating member sealing the sorbent portion and the refrigerant.

12. A device, according to claim 11, wherein the encapsulating member comprises:

an epoxy.

13. A device, according to claim 11, wherein the sorbent portion comprises:

at least one of one or more metal salts, one or more complex compounds produced from one or more metal salts, one or more metal hydrides, zeolite, activated carbon, alumina, and silica gel.

14. A device, according to claim 11, wherein the refrigerant is one of water, amines, alcohols, and ammonia.

15. A device, according to claim 11, further comprising:

a temperature-sensitive plug disposed through the encapsulating member.

16. A device, according to claim 11, wherein the sorbent portion comprises:

a woven material.

17. A device, according to claim 1, wherein the sorbing refrigeration device comprises:

an armor.

18. A device according to claim 1, wherein the sorbing refrigeration device comprises:

at least one sorbent layer comprising a substrate and a sorbent capable of sorbing a refrigerant; and an encapsulating member sealing the at least one sorbent layer.

19. A device, according to claim 18, wherein the substrate comprises:

at least one of silicon carbide, alumina, glass, an aramid fiber, Kevlar®, Vectran®, Nomex®, Spectra®, Teflon®, Conex®, an olefin-aramid fiber combination, a polyethylene-Spectra® combination, high-density polyethylene, melamine, polybenzimidazole, polyphenylenebenzobisozazole, phenolic, novaloid phenolic, polyacrylate, polyacrylate liquid crystal, polyphenylene sulfide, polytetrafluoroethylene, polyunude, polyamide-imide, nylon-based carbon, nylon-based graphite, pitch-based carbon, pitch-based graphite, polyacrylonitrile-based carbon, and polyacrylonitrile-based graphite.

20. A container, comprising:

an energetic material; and a sorbing refrigeration device at least partially surrounding the energetic material.

21. A container, according to claim 20, wherein the sorbing refrigeration device comprises:

a sorbent portion capable of sorbing a refrigerant and an encapsulating member sealing the sorbent portion.

22. A container, according to claim 20, further comprising:

a return conduit in fluid communication with the sorbent portion;

an evaporator in fluid communication with the sorbent portion;

a capillary tube; and a receiver in fluid communication with the return conduit and in fluid communication with the evaporator via the capillary tube.

23. A container, according to claim 20, further comprising:

a secondary conduit, the receiver being in fluid communication with the evaporator via the secondary conduit.

24. A container, according to claim 20, wherein the sorbing refrigeration device comprises:

a refrigerant, a sorbent portion capable of sorbing the refrigerant, and an encapsulating member sealing the sorbent portion and the refrigerant.

25. A container, according to claim 20, wherein the sorbing refrigeration device comprises:

at least one sorbent layer at least partially surrounding the energetic material, the at least one sorbent layer including a substrate and a sorbent capable of sorbing a refrigerant.

26. A container, according to claim 20, wherein the container is one of a munition and a container for a munition.

27. A method for inhibiting an inadvertent initiation of a munition, comprising:

cooling an energetic material of the munition by sorption refrigeration.

28. A method, according to claim 27, further comprising:

inhibiting an entry of a projectile into the energetic material.

29. A method, according to claim 27, wherein cooling the energetic material further comprises:

desorbing a refrigerant from a sorbent.

30. A method, according to claim 27, wherein cooling the energetic material further comprises:

desorbing a refrigerant from a sorbent;

flowing the refrigerant from the sorbent to a receiver;

flowing the refrigerant from the receiver to an evaporator; and sorbing the refrigerant into the sorbent.

* * * * *